US005563019A

United States Patent [19]

Blanchet-Fincher

[11] Patent Number: 5,563,019

[45] **Date of Patent: * Oct. 8, 1996**

[54] DONOR ELEMENT FOR LASER-INDUCED THERMAL TRANSFER

[75] Inventor: Graciela Blanchet-Fincher, Wilmington, Del.

[73] Assignee: E. I. Du Pont de Nemours and Company, Wilmington, Del.

[ * ] Notice: The portion of the term of this patent subsequent to Jun. 30, 2014, has been disclaimed.

[21] Appl. No.: 268,461

[22] Filed: Jun. 30, 1994

[51] Int. Cl.[6] ..... G03C 5/54; G03C 1/94

[52] U.S. Cl. ..... 430/200; 430/275.1; 430/276.1; 430/278.1; 430/945; 430/964

[58] Field of Search ..... 430/200, 945, 430/275, 276, 278, 964

[56] References Cited

U.S. PATENT DOCUMENTS

| | | | |
|---|---|---|---|
| 5,156,938 | 10/1992 | Foley et al. | 430/200 |
| 5,171,650 | 12/1992 | Ellis et al. | 430/20 |
| 5,308,737 | 5/1994 | Bills et al. | 430/945 |

*Primary Examiner*—Charles L. Bowers, Jr.
*Assistant Examiner*—Christopher G. Young

[57] ABSTRACT

A donor element for use in a laser-induced thermal transfer process, said element comprising a support bearing on a first surface thereof in the order listed (a) at least one ejection layer comprising a first polymer having a decomposition temperature $T_1$; (b) at least one heating layer; (c) at least one transfer layer comprising (c) a second polymer having a decomposition temperature $T_2$ and (ii) an imageable component; wherein $T_2 \geqq (T_1+100)$ is described.

14 Claims, 2 Drawing Sheets

DONOR ELEMENT FOR LASER-INDUCED THERMAL TRANSFER

FIELD OF THE INVENTION

This invention relates to a donor element for laser-induced thermal transfer processes. More particularly, it relates to a multilayer donor element.

BACKGROUND OF THE INVENTION

Laser-induced thermal transfer processes are well-known in applications such as color proofing and lithography. Such laser-induced processes include, for example, dye sublimation, dye transfer, melt transfer, and ablative material transfer. These processes have been described in, for example, Baldock, UK patent 2,083,726; DeBoer, U.S. Pat. No. 4,942,141; Kellogg, U.S. Pat. No. 5,019,549; Evans, U.S. Pat. No. 4,948,776; Foley et al., U.S. Pat. No. 5,156,938; Ellis et al., U.S. Pat. No. 5,171,650; and Koshizuka et al., U.S. Pat. No. 4,643,917.

Laser-induced processes use a laserable assemblage comprising (a) a donor element that contains the imageable component, i.e., the material to be transferred, and (b) a receiver element. The donor element is imagewise exposed by a laser, usually an infrared laser, resulting in transfer of material to the receiver element. The exposure takes place only in a small, selected region of the donor at one time, so that the transfer can be built up one pixel at a time. Computer control produces transfer with high resolution and at high speed.

For the preparation of images for proofing applications, the imageable component is a colorant. For the preparation of lithographic printing plates, the imageable component is an olephilic material which will receive and transfer ink in printing.

Laser-induced processes are fast and result in transfer of material with high resolution. However, in many cases, the resulting transferred material does not have the required durability of the transferred image. In dye sublimination processes, light-fastness is frequently lacking. In ablative and melt transfer processes, poor adhesion and/or durability can be a problem.

SUMMARY OF THE INVENTION

This invention provides a donor element for use in a laser-induced thermal transfer process, said element comprising a support bearing on a first surface thereof, in the order listed:

(a) at least one ejection layer comprising a first polymer having a decomposition temperature $T_1$;

(b) at least one heating layer;

(c) at least one transfer layer comprising (i) a second polymer having a decomposition temperature $T_2$ and an imageable component; wherein $T_2 \geqq (T_1+100)$.

In a second embodiment this invention concerns a laser-induced thermal transfer process comprising:

(1) imagewise exposing to laser radiation a laserable assemblage comprising:

(A) a donor element comprising a support bearing on a first surface thereof, in the order listed:

(a) at least one ejection layer comprising a first polymer having a decomposition temperature $T_1$;

(b) at least one heating layer;

(c) at least one transfer layer comprising (i) a second polymer having a decomposition temperature $T_2$ and an imageable component; wherein $T_2 \geqq (T_1+100)$; and (B) a receiver element in contact with the first surface of the donor element; wherein a substantial portion of the transfer layer is transferred to the receiver element; and (2) separating the donor element from the receiver element, Steps (1)–(2) can be repeated at least once using the same receiver element and a different donor element having an imageable component the same as or different from the first imageable component.

DETAILED DESCRIPTION OF THE INVENTION

Figure 1:
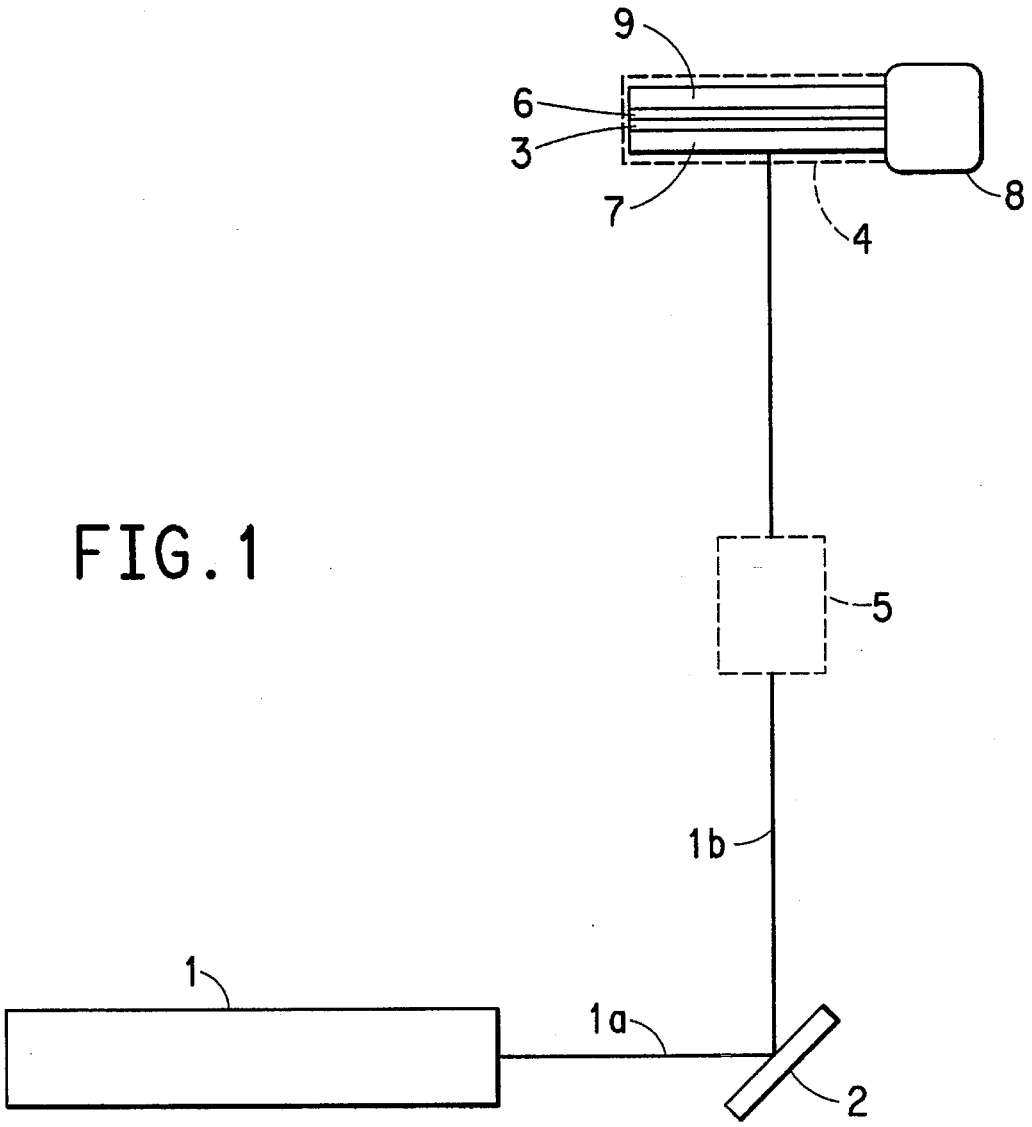
FIG. 1 illustrates a laser imaging apparatus comprising an infrared laser (1), laser beam 1 (*a*) , an infrared mirror (2), reflected beam 1(*b*), a power meter (5), a translator (8), a donor element (3) and a receiver element (6). The donor element and receiver element are held in place by an acrylic plate (7), and a flat metal plate (9). The donor and receiver-elements and acrylic and metal plates are housed in a sample holder (4).

This invention concerns a donor element for a laser-induced, thermal transfer process, and a process of use for such an element. The donor element comprises a support bearing at least three layers. The layers have been chosen such that the specific functions required in the laser imaging process are addressed by different layers, which are formulated accordingly. That is, the required functions of heating, decomposition, and transfer are fully decoupled and independently formulated in one of the three specific layers. The donor element is combined with a receiver element to form a laserable assemblage which is imagewise exposed by a laser to effect transfer of an imageable component from the donor element to the receiver element.

It was found that a donor element, such as the one described in the present invention, when used in a laser induced, non-explosive, thermal transfer process, produces improved durability in the transferred image. It is believed that the improved transferred image durability is due to the transfer of both non-degraded polymeric binder and imageable components to the receiver element.

Donor Element

The donor element comprises a support, bearing on a first surface thereof: (a) at least one ejection layer comprising a first polymer; (b) at least one heating layer; and (c) at least one transfer layer comprising (i) a binder which is a second polymer and (ii) an imageable component. The decomposition temperature of the first polymer is $T_1$, the decomposition temperature of the second polymer is $T_2$, and $T_2 \geqq (T_1+100)$.

1. Support

Any dimensionally stable, sheet material can be used as the donor support. If the laserable assemblage is imaged through the donor support, the support should be capable of transmitting the laser radiation, and not be adversely affected by this radiation. Examples of suitable materials include, polyesters, such as polyethylene terephthalate and polyethylene naphthanate; polyamides; polycarbonates; fluoropolymers; polyacetals; polyolefins; etc. A preferred support material is polyethylene terephthalate film.

The donor support typically has a thickness of about 2 to about 250 micrometers, and can have a subbing layer, if desired. A preferred thickness is about 10 to 50 micrometers.

2. Ejection Layer

The ejection layer is the first of the three functional layers, positioned closest to the support surface. This layer provides the force to effect transfer of the imageable component to the receiver element. When heated, this layer decomposes into small gaseous molecules providing the necessary pressure to propel or eject the imageable component onto the receiver element. This is accomplished by using a polymer having a relatively low decomposition temperature.

Examples of suitable polymers include (a) polycarbonates having low decomposition temperatures (Td), such as polypropylene carbonate; (b) substituted styrene polymers having low decomposition temperatures, such as poly-alphamethylstyrene; (c) polyacrylate and polymethacrylate esters, such as polymethylmethacrylate and polybutylmethacrylate; (d) cellulosic materials such as cellulose acetate butyrate and nitrocellulose; and (e) other polymers such as polyvinyl chloride; polyacetals; polyvinylidene chloride; polyurethanes with low Td; polyesters; polyorthoesters; acrylonitrile and substituted acrylonitrile polymers; maleic acid resins; and copolymers of the above. Mixtures of polymers can also be used. Additional examples of polymers having low decomposition temperatures can be found in Foley et al., U.S. Pat. No. 5,156,938. These include polymers which undergo acid-catalyzed decomposition. For these polymers, it is frequently desirable to include one or more hydrogen donors with the polymer.

Preferred polymers for the ejection layer are polyacrylate and polymethacrylate esters, low Td polycarbonates, nitrocellulose, and poly(vinyl chloride). Most preferred is poly(vinyl chloride).

In general, it is preferred that the polymer for the ejection layer has a decomposition temperature less than 325° C., more preferably less than 275° C.

Other materials can be present as additives in the ejection layer as long as they do not interfere with the essential function of the layer. Examples of such additives include coating aids, plasticizers, flow additives, slip agents, antihalation agents, antistatic agents, surfactants, and others which are known to be used in the formulation of coatings.

The ejection layer generally has a thickness in the range of about 0.5 to 20 micrometers, preferably in the range of about 0.7 to 5 micrometers. Thicknesses greater than about 25 micrometers are generally not preferred as this may lead to delamination and cracking unless the layer is highly plasticized.

Although it is preferred to have a single ejection layer, it is also possible to have more than one ejection layer, and the different ejection layers can have the same or different compositions, as long as they all function as described above. The total thickness of all the ejection layers should be in the range given above, i.e., 0.5 to 20 micrometers.

The ejection layer(s) can be coated onto the donor support as a dispersion in a suitable solvent, however, it is preferred to coat the layer(s) from a solution. Any suitable solvent can be used as a coating solvent, as long as it does not deleteriously affect the properties of the assemblage, using conventional coating techniques or printing techniques, such as those used in, for example, gravure printing.

3. Heating Layer

The heating layer is deposited on the ejection layer, further removed from the support. The function of the heating layer is to absorb the laser radiation and convert the radiation into heat. Materials suitable for the layer can be inorganic or organic and can inherently absorb the laser radiation or include additional laser-radiation absorbing compounds.

Examples of suitable inorganic materials are transition metal elements, and metallic elements of Groups IIIa, IVa, Va and VIa, their alloys with each other, and their alloys with the elements of Groups Ia and IIa. Preferred metals include Al, Cr, Sb, Ti, Bi, Zr, $TiO_2$, Ni, In, Zn, and their alloys. Particularly preferred are Al, Ni, Cr, and Zr.

The thickness of the heating layer is generally about 20 Angstroms to 0.1 micrometers, preferable about 50 to 100 Angstroms.

Although it is preferred to have a single heating layer, it is also possible to have more than one heating layer, and the different layers can have the same or different compositions, as long as they all function as described above. In the case of multiple heating layers it may be necessary to add a laser radiation absorbing component in order to get effective heating of the layer. The total thickness of all the heating layers should be in the range given above, i.e., 20 Angstroms to 0.1 micrometers.

The heating layer(s) can be applied using any of the well-known techniques for providing thin metal layers, such as sputtering, chemical vapor deposition and electron beam.

4. Transfer Layer

The transfer layer comprises (i) a polymeric binder which is different from the polymer in the ejection layer, and (ii) an imageable component.

The binder for the transfer layer is a polymeric material having a decomposition temperature of at least 100° C. greater than the decomposition temperature of the binder in the ejection layer, preferably more than 150° C. greater. The binder should be film forming and coatable from solution or from a dispersion. It is preferred that the binder have a relatively low melting point to facilitate transfer. Binders having melting points less than about 250° C. are preferred. However, heat-fusible binders, such as waxes should be avoided as the sole binder since such binders may not be as durable.

It is preferred that the binder does not self-oxidize, decompose or degrade at the temperature achieved during the laser exposure so that the imageable component and binder are transferred intact for improved durability. Examples of suitable binders include copolymers of styrene and (meth) acrylate esters, such as styrene/methyl-methacrylate; copolymers of styrene and olefin monomers, such as styrene/ethylene/butylene; copolymers of styrene and acrylonitrile; fluoropolymers; copolymers of (meth) acrylate esters with ethylene and carbon monoxide; polycarbonates having higher decomposition temperatures; (meth) acrylate homopolymers and copolymers; polysulfones; polyurethanes; polyesters. The monomers for the above polymers can be substituted or unsubstituted. Mixtures of polymers can also be used.

In general, it is preferred that the polymer for the transfer layer have a decomposition temperature greater than 400° C. Preferred polymers for the transfer layer are ethylene copolymers, as they provide high decomposition temperatures with low melting temperatures and high specific heat. Most preferred is a copolymer of n-butyl acrylate, ethylene and carbon monoxide.

The binder polymer generally has a concentration of about 15–50% by weight, based on the total weight of the transfer layer, preferably 30–40% by weight.

The nature of the imageable component will depend on the intended application for the assemblage. The imageable component preferably has a decomposition temperature that is greater than that of the polymeric material in the ejection layer. It is most preferred that the imageable component have a decomposition that is at least as great as the decomposition temperature of the binder polymer in the transfer layer.

For imaging applications, the imageable component will be a colorant. The colorant can be a pigment or a non-sublimable dye. It is preferred to use a pigment as the colorant for stability and for color density, and also for the high decomposition temperature. Examples of suitable inorganic pigments include carbon black and graphite. Examples of suitable organic pigments include Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751D (C.I. No. Pigment Green 7). Combinations of pigments and/or dyes can also be used.

In accordance with principles well known to those skilled in the art, the concentration of colorant will be chosen to achieve the optical density desired in the final image. The amount of colorant will depend on the thickness of the active coating and the absorption of the colorant. Optical densities greater than 1.3 at the wavelength of maximum absorption are typically required.

A dispersant is usually present when a pigment is to be transferred, in order to achieve maximum color strength, transparency and gloss. The dispersant is generally an organic polymeric compound and is used to separate the fine pigment particles and avoid flocculation and agglomeration. A wide range of dispersants is commercially available. A dispersant will be selected according to the characteristics of the pigment surface and other components in the composition as practiced by those skilled in the art. However, dispersants suitable for practicing the invention are the AB dispersants. The A segment of the dispersant adsorbs onto the surface of the pigment. The B segment extends into the solvent into which the pigment is dispersed. The B segment provides a barrier between pigment particles to counteract the attractive forces of the particles, and thus to prevent agglomeration. The B segment should have good compatibility with the solvent used. The AB dispersants of choice are generally described in "Use of AB Block Polymers as Dispersants for Non-aqueous Coating Systems", by H. C. Jakubauskas, Journal of Coating Technology, Vol. 58, No. 736, pages 71–82. Suitable AB dispersants are also disclosed in U.K. Patent 1,339,930 and U.S. Pat. Nos. 3,684,771; 3,788,996; 4,070,388; 4,912,019; and 4,032,698. Conventional pigment dispersing techniques, such as ball milling, sand milling, etc., can be employed.

For lithographic applications, the imageable component is an oleophilic, ink-receptive material. The oleophilic material is usually a film-forming polymeric material and may be the same as the binder. Examples of suitable oleophilic materials include polymers and copolymers of acrylates and methacrylates; polyolefins; polyurethanes; polyesters; polyaramids; epoxy resins; novolak resins; and combinations thereof. Preferred oleophilic materials are acrylic polymers.

The imageable component can also be a a resin capable of undergoing a hardening or curing reaction after transfer to the receiver element. The term "resin" as used herein encompasses (a) low molecular weight monomers or oligomers capable of undergoing polymerization reactions, (b) polymers or oligomers having pendant reactive groups which are capable of reacting with each other in crosslinking reactions, (c) polymers or oligomers having pendant reactive groups which are capable of reacting with a separate crosslinking agent, and (d) combinations thereof. The resin may or may not require the presence of a curing agent for the curing reaction to occur. Curing agents include catalysts, hardening agents, photoinitiators and thermal initiators. The curing reaction can be initiated by exposure to actinic radiation, heating, or a combination of the two.

In lithographic applications, a colorant can also be present in the transfer layer. The colorant facilitates inspection of the plate after it is made. Any of the colorants discussed above can be used. The colorant can be a heat—, light—, or acid-sensitive color former.

In general, for both color proofing and lithographic printing applications, the imageable component is present in an amount of from about 25 to 95% by weight, based on the total weight of the transfer coating. For color proofing applications, the amount of imageable component is preferably 35–65% by weight; for lithographic printing applications, preferably 65–85% by weight.

Although the above discussion was limited to color proofing and lithographic printing applications, the element and process of the invention apply equally to the transfer of other types of imageable components in different applications. In general, the scope of the invention in intended to include any application in which solid material is to be applied to a receptor in a pattern. Examples of other suitable imageable components include, but are not limited to, magnetic materials, fluorescent materials, and electrically conducting materials.

Other materials can be present as additives in the transfer layer as long as they do not interfere with the essential function of the layer. Examples of such additives include coating aids, plasticizers, flow additives, slip agents, antihalation agents, antistatic agents, surfactants, and others which are known to be used in the formulation of coatings. However, it is preferred to minimize the amount of additional materials in this layer, as they may deleteriously affect the final product after transfer. Additives may add unwanted color for color proofing applications, or they may decrease durability and print life in lithographic printing applications.

The transfer layer generally has a thickness in the range of about 0.1 to 5 micrometers, preferably in the range of about 0.1 to 2 micrometers. Thicknesses greater than about 5 micrometers are generally not preferred as they require excessive energy in order to be effectively transferred to the receiver.

Although it is preferred to have a single transfer layer, it is also possible to have more than one transfer layer, and the different layers can have the same or different compositions, as long as they all function as described above. The total thickness of all the transfer layers should be in the range given above.

The transfer layer(s) can be coated onto the donor support as a dispersion in a suitable solvent, however, it is preferred to coat the layer(s) from a solution. Any suitable solvent can be used as a coating solvent, as long as it does not deleteriously affect the properties of the assemblage, using conventional coating techniques or printing techniques, for example, gravure printing.

The donor element can have additional layers as well. For example, an antihalation layer can be used on the side of the support opposite the transfer layer. Materials which can be used as antihalation agents are well known in the art. Other anchoring or subbing layers can be present on either side of the support and are also well known in the art.

Receiver Element

The receiver element is the second part of the laserable assemblage, to which the imageable component and non-degraded polymeric binder are transferred. In most cases, the imageable component will not be removed from the donor element in the absence of a receiver element. That is, exposure of the donor element alone to laser radiation does not cause material to be removed, or transferred into air. The material, i.e., the imageable component and binder, is removed from the donor element only when it is exposed to laser radiation and the donor element is in intimate contact with the receiver element, i.e., the donor element actually touches the receiver element. This implies that, in such cases, complex transfer mechanisms are in operation.

The receiver element typically comprises a receptor support and, optionally, an image-receiving layer. The receptor support comprises a dimensionally stable sheet material. The assemblage can be imaged through the receptor support if that support is transparent. Examples of transparent films include, for example polyethylene terephthalate, polyether sulfone, a polyimide, a poly(vinyl alcohol-co-acetal), or a cellulose ester, such as cellulose acetate. Examples of opaque support materials include, for example, polyethylene terephthalate filled with a white pigment such as titanium dioxide, ivory paper, or synthetic paper, such as Tyvek® spunbonded polyolefin. Paper supports are preferred for proofing applications. For lithographic printing applications, the support is typically a thin sheet of aluminum, such as anodized aluminum, or polyester.

Although the imageable component can be transferred directly to the receptor support, the receiver element typically has an additional receiving layer on one surface thereof. For image formation applications, the receiving layer can be a coating of, for example, a polycarbonate, a polyurethane, a polyester, polvinyl chloride, styrene/acrylonitrile copolymer, poly(caprolactone), and mixtures thereof. This image receiving layer can be present in any amount effective for the intended purpose. In general, good results have been obtained at coating weights of 1 to 5 g/m$^2$. For lithographic applications, typically the aluminum sheet is treated to form a layer of anodized aluminum on the surface as a receptor layer. Such treatments are well known in the lithographic art.

The receiver element does not have to be the final intended support for the imageable component. In other words, the receiver element can be an intermediate element and the laser imaging step can be followed by one or more transfer steps by which the imageable component is transferred to the final support. This is most likely the case for multicolor proofing applications in which the multicolor image is built up on the receiver element and then transferred to the permanent paper support.

Process Steps

1. Exposure

The first step in the process of the invention is imagewise exposing the laserable assemblage to laser radiation. The laserable assemblage comprises the donor element and the receiver element, described above.

The assemblage is prepared by placing the donor element in contact with the receiver element such that the transfer coating actually touches the receiver element or the receiving layer on the receiver element.

Vacuum or pressure can be used to hold the two elements together. Alternatively, the donor and receiver elements can be taped together and taped to the imaging apparatus, or a pin/clamping system can be used. The laserable assemblage can be conveniently mounted on a drum to facilitate laser imaging.

Various types of lasers can be used to expose the laserable assemblage. The laser is preferably one emitting in the infrared, near-infrared or visible region. Particularly advantageous are diode lasers emitting in the region of 750 to 870 nm which offer a substantial advantage in terms of their small size, low cost, stability, reliability, ruggedness and ease of modulation. Diode lasers emitting in the range of 780 to 850 nm are most preferred. Such lasers are available from, for example, Spectra Diode Laboratories (San Jose, Calif.).

The exposure can take place through the support of the donor element or through the receiver element, provided that these are substantially transparent to the laser radiation. In most cases, the donor support will be a film which is transparent to infrared radiation and the exposure is conveniently carried out through the support. However, if the receiver element is substantially transparent to infrared radiation, the process of the invention can also be carried out by imagewise exposing the receiver element to infrared laser radiation.

The laserable assemblage is exposed imagewise so that material, i.e., the binder and the imageable component, is transferred to the receiver element in a pattern. The pattern itself can be, for example, in the form of dots or linework generated by a computer, in a form obtained by scanning artwork to be copied, in the form of a digitized image taken from original artwork, or a combination of any of these forms which can be electronically combined on a computer prior to laser exposure. The laser beam and the laserable assemblage are in constant motion with respect of each other, such that each minute area of the assemblage, i.e., "pixel" is individually addressed by the laser. This is generally accomplished by mounting the laserable assemblage on a rotatable drum. A flat bed recorder can also be used.

2. Separation

The next step in the process of the invention is separating the donor element from the receiver element. Usually this is done by simply peeling the two elements apart. This generally requires very little peel force, and is accomplished by simply separating the donor support from the receiver element. This can be done using any conventional separation technique and can be manual or automatic without operator intervention.

Throughout the above discussions, the intended product has been the receiver element, after laser exposure, onto which the imageable component has been transferred in a pattern. However, it is also possible for the intended product to be the donor element after laser exposure. If the donor support is transparent, the donor element can be used as a phototool for conventional analog exposure of photosensitive materials, e.g., photoresists, photopolymer printing plates, photosensitive proofing materials and the like. For phototool applications, it is important to maximize the density difference between "clear", i.e., laser exposed and "opaque", i.e., unexposed areas of the donor element. Thus the materials used in the donor element must be tailored to fit this application.

EXAMPLES

| Glossary | |
|---|---|
| BINDERS: | |
| CAB551-0.01 | cellulose acetate butyrate, 2% acetyl, 53% butyryl Td = 338° C. |
| CAB381-0.1 | cellulose acetate butyrate, 13.5% acetyl, 38% butyl Td = 328° C. |
| E1010 | Elavacite 1010 (DuPont) Poly Methyl Methacrylate with double bonded carbon chain ends. Tg = 42° C., Td1 = 176, Td2 = 284° C. |
| E2051 | Elavacite 2051 (DuPont) Poly Methyl Methacrylate, Tg = 98° C. Td = 350° C. |
| NC | nitrocellulose (Hercules) Td = 194° C. |
| P-αMS | poly alphamethyl styrene (Aldrich) $Td_1$ = 240° C., Td2 = 339° C. |
| E2045 | Elvacite 2045, polybutyl methacrylate (DuPont) $Td_1$ = 155° C., Td2 = 284.1° C. |
| PAC-40 | PPC = polypropylene carbonate (PAC Polymers, Inc. Allentown, PA) Td = 160° C. |
| PVC | poly(vinyl chloride) (Aldrich) $Td_1$ = 282° C., Td2 = 465° C. |
| TRANSFER LAYER BINDERS: | |
| AF1601 | 2,2-bis(trifluoromethyl)-4,5-difluoro-1,3 dioxole, Td = 550° C. (DuPont) |
| EP4043 | 10% CO, 30% nbutylacrylate and 60% ethylene copolymyer Td = 457° C. (DuPont) |
| K-1101 | Kraton ® 1101 (Shell) Styrene-butadiene-styrene ABA block copolymer, 31 molar % styrene, Td = 465° C. |
| PC | Lexan ® 101, Polycarbonate, Td = 525° C. |
| PSMMA | Polystyrene/methyl-methacrylate (70:20) Td = 425° C. |
| SEB | Styrene/ethylene-butylene |
| SP2 | ABA block copolymer 29% styrene Td = 446° C. |
| OTHER MATERIALS: | |
| Dispersant | AB dispersant |
| CyHex | cyclohexanone |
| DBP | dibutyl phosphate |
| DPP | diphenyl phosphate |
| IR165 | Cyasorb IR-165 light absorber (Cyaramid) |
| L31 | Pluronic L31 Sufactant (BASF) |
| MC | methylene chloride |
| MEK | methyl ethyl ketone |
| PEG | polyethylene glycol |
| TEGDA | tetraethylene glycol diacrylate |

Procedure 1

The images were exposed using the fundamental line of a GCR 170 Nd-YAG laser (1) (Spectra Physics, Mountain View, Calif.), which could be operated in either a long pulse or Q-switched mode. The experimental set up is shown in FIG. 1. The 1.064 micron beam 1(*a*) was reflected onto a 45° infrared mirror, (2). The reflected beam, 1(*b*), 90° off the incident radiation, was incident onto the donor element (3) (3.81 cm×10.16 cm) positioned in sample holder (4) placed 50 cm away. This was translated perpendicular to the laser beam. The laser power was measured by using a power meter (5), positioned directly after the mirror and removed from the beam during exposure.

When the apparatus was used for imaging, sample holder (4) consisted of acrylic plate (7) a donor element (3), a receiver element (6), and flat metal plate (9) which were held together by screws. The donor support was next to the acrylic plate and the non-receiving side of the receiver element was next to the metal plate.

Figure 2:
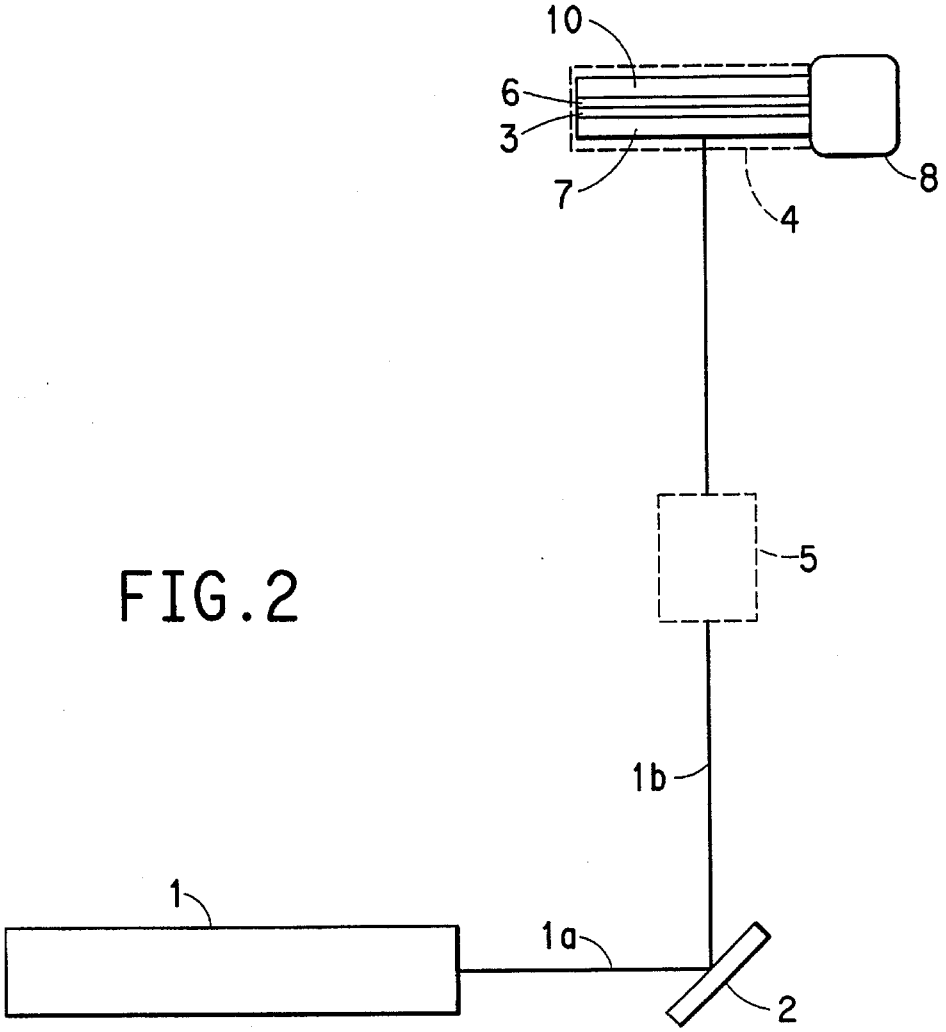
FIG. 2 illustrates a laser imaging apparatus containing all of the components mentioned in FIG. 1 with the exception that a U-shaped metal plate (10) is used instead of the flat metal plate (9).
Figure 3:
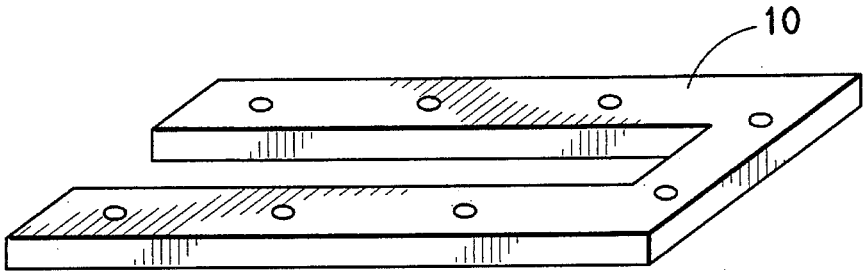
FIG. 3 illustrates a perspective plan view of the U-shaped metal plate (10) referred to in FIG. 2.

When the apparatus was used to test donor film sensitivity, the sample holder (4) consisted of an acrylic plate (7) and a U-shaped metal plate (10) which were held together by screws. See FIG. 2. Into the sample holder was placed a donor element (3) such that the donor support was next to the acrylic plate (7). The u-shaped metal back allowed the exposed film to expand freely away from the laser beam, without any backing behind it.

For the Q-switched mode, the power was varied from 10 to 100 mJ/cm$^2$ in increments of 5 mJ/cm$^2$. For the long pulse mode, the power was varied from 100 to 800 mJ/cm$^2$ in increments of 100 mJ/cm$^2$. The power was adjusted either by varying the laser output or by introducing beam splitters with varying percentage of reflection along the beam path. The laser was run in the single spot mode at two different pulse widths: 10 nanoseconds for the Q-switched mode; 300 microseconds for the long pulse mode.

To determine sensitivity, the donor film was placed in the sample holder and a single shot of the desired power was fired. The film was then translated by 0.5 inch (1.27 cm), the power decreased to its new value, and a new shot fired. These steps were repeated with decreasing power until the exposure fluence was insufficient to write the film. The sensitivity, or ablation threshold, corresponded to the minimum laser power required for transfer or material removal to occur.

Procedure 2

The laser imaging apparatus was a Creo Plotter (Creo Corp., Vancouver, BC) with 32 infrared lasers emitting at 830 nm, with a 3 microseconds pulse width. The laser fluence was calculated based on laser power and drum speed.

The receiver element, paper, was placed on the drum of the laser imaging apparatus. The donor element was then placed on top of the receiver element such that the transfer layer of the donor element was adjacent to the receiving side of the receiver element. A vacuum was then applied.

To determine sensitivity of the film, stripes of full burn pattern were obtained and drum speeds varied from 100 to 400 rpm in 25 rpm increments. The density of the image transferred onto paper was measured using a MacBeth densitometer in a reflectance mode for each of the stripes written at the different drum speeds. The sensitivity was the minimum laser power required for transfer of material to occur, with a density greater than 1.

Examples 1–11

These examples illustrate the advantage the ejection layer provides in terms of increased film sensitivity.

The samples consisted of a support of Mylar® 200 D polyester film (E. I. du Pont de Nemours and Company, Wilmington, Del.) coated with an ejection layer which was then coated with a heating layer. The control was the same support material having only the heating layer.

Each ejection layer was bar coated by hand from methylene chloride onto a support to a dry thickness of 8 to 10 microns as determined by a profilometer. The compositions of the different ejection layers are given in Table 1 below.

The ejection layers of the samples, and the support of the control, were then covered with a heating layer consisting of a layer of aluminum approximately 80 Å thick. The aluminum was applied by sputtering using a Denton 600 unit (Denton, N.J.) in a 50 militorr Ar atmosphere.

The sensitivities of the films were measured using Procedure 1 for both the Q-switched ("A") and long pulse modes ("B"). The results are given in Table 1 below and clearly demonstrate the increased sensitivity of the films having the ejection layer. The films with the ejection layer require much lower laser energies for transfer to occur.

TABLE 1

| Sample | Ejection Layer | Sensitivity (mJ/cm²) A | Sensitivity (mJ/cm²) B |
|---|---|---|---|
| control | none | 50 | 600 |
| Ex. 1 | PAMS | 25 | 150 |
| Ex. 2 | PBMA | 30 | 150 |
| Ex. 3 | CAB 1 | 30 | 175 |
| Ex. 4 | CAB 2 | 25 | 400 |
| Ex. 5 | PVC | 20 | 200 |
| Ex. 6 | PPC | 25 | 400 |
| Ex. 7 | NC | 30 | 500 |
| Ex. 8 | E1010 | 20 | 150 |
| Ex. 9 | PMMA | 25 | 200 |
| Ex. 10 | E2051 | 25 | 150 |
| Ex. 11 | PBMA + 10% DBP | 20 | 150 |

Examples 12–20

These examples illustrate the improved sensitivity of the three-layer film structure of the donor element of the invention.

Examples 12–20 consisted of a donor element having the following structure: support, ejection layer, heating layer, transfer layer. The control consisted of a donor element without the ejection layer, i.e., support, heating layer, and transfer layer.

The support was Mylar® 200 D. For the examples, the ejection layer was coated from a solvent system of methylene chloride and isopropanol (92:8). DPP was added at a level of 10% by weight, based on the weight of the solids in the ejection layer. The solids in the solutions were adjusted to obtain viscosities of about 300–400 cp. The layers were coated onto the support using an automatic coater to a dry thickness of 10 microns, with the exception of Example 12, which was coated to a thickness of 3 microns. A 1 mil (25 micron) polyethylene coversheet was laminated to the ejection layer during coating to protect the layer from scratching and dust.

A heating layer of aluminum was sputtered onto the ejection layers of the examples, and the support of the control, using a Denton unit. The metal thickness was monitored in situ using a quartz crystal, and, after deposition, by measuring the reflection and transmission of the films. The thickness of the aluminum heating layer was about 60 Å.

A transfer layer was coated over the heating layer in all the samples. The transfer layer was coated by hand to a dry thickness of between 0.7 and 1.0 microns. The coatings used for the transfer layers had the compositions given in below.

| | |
|---|---|
| Cyan dispersion: | |
| cyan pigment Heucophthal Blue G (Heubach Inc., Newark, N.J.) | 45.92 g |
| AB1030 | 19.68 g |
| MEK/CyHex (60/40) | 372 g |
| % solids | 15 |
| K dispersion: | |
| C black | 70 g |
| AB1030 | 30 g |
| MEK/CyHex (60/40) | 300 g |
| % solids | 25 |
| Transfer coating 1 (TC1) | |
| EP4043 | 7.5 g |
| Cyan dispersion | 50 g |
| PEG | 5 g |
| L31 | 1.5 g |
| IR165 | 0.1 g |
| MC | 79.9 g |
| % solids | 15 |
| Transfer coating 2 (TC2) | |
| EP4043 | 7.5 g |
| Cyan dispersion | 50 g |
| PEG | 1.56 g |
| IR165 | 0.082 g |
| MEK | 85.65 g |
| % solids | 13 |
| Transfer coating 3 (TC3) | |
| PSMMA | 7.5 g |
| Cyan dispersion | 50 g |
| TEGDA | 3.0 g |
| MEK | 83.5 g |
| % solids | 12.5 |
| Transfer coating 4 (TC4) | |
| EP4043 | 7.5 g |
| Cyan dispersion | 50 g |
| PEG | 3.75 g |
| MEK | 107.5 g |
| % solids | 12.5 |
| Transfer coating 5 (TC5) | |
| EP4043 | 7.5 g |
| Cyan dispersion | 50 g |
| MEK | 77.5 g |
| % solids | 12.5 |
| Transfer coating 6 (TC6) | |
| EP4043, 6% solution in MEK | 39.58 g |
| DPP | 0.46 g |
| K dispersion | 9.5 g |
| % solids | 11.2 |

The sensitivities of the films were measured using Procedure 1 for the Q-switched mode. The results are given in Table 2 below and clearly demonstrate the increased sensitivity of the films having the ejection layer. The films with the ejection layer require much lower laser energies for transfer to occur.

TABLE 2

| Sample | Layer[a] | Layer | Sensitivity (mJ/cm²) |
|---|---|---|---|
| control | none | TC1 | 250 |
| Ex. 12 | PAMS | TC1 | 25 |
| Ex. 13 | PAMS | TC2 | 50 |
| Ex. 14 | PBMA | TC2 | 100 |
| Ex. 15 | PBMA | TC2 | 75 |
| Ex. 16 | PBMA | TC3 | 40 |
| Ex. 17 | PBMA | TC5 | 60 |

TABLE 2-continued

| Sample | Layer[a] | Layer | Sensitivity (mJ/cm$^2$) |
|---|---|---|---|
| Ex. 18 | CAB 2 | TC4 | 75 |
| Ex. 19 | NC | TC6 | 60 |
| Ex. 20 | PVC | TC6 | 60 |

[a]with 10 wt % DPP

Example 21

This example illustrates the increased sensitivity of films with the ejection layer.

The donor film sample for example 21 had a support of Mylar® 200 D film, a 5 micron thick ejection layer of PVC (coated from methylethylketone), and an 85 Å thick heating layer of sputtered chromium. A transfer layer having TC6 composition, was coated on this with rods 5, 6 and 7 to thicknesses of about 0.8, 1.0 and 1.2 microns, respectively.

The control had the same structure, but without the ejection layer.

The sensitivities of the films were measured using Procedure 2, with a beam size of 5.8 microns. The results are given in Table 3 below and clearly demonstrate the increased sensitivity of the films having the ejection layer.

TABLE 3

| Sample ID | rod | Vd (RPM)* | Density | TavF**(mJcm2) |
|---|---|---|---|---|
| Control | 5 | 100 | 1.05 | 792 |
| Control | 5 | 125 | 0.75 | 634 |
| Control | 5 | 150 | 0.05 | 528 |
| Ex. 21 | 5 | 100 | 1.28 | 792 |
| Ex. 21 | 5 | 125 | 1.29 | 634 |
| Ex. 21 | 5 | 150 | 1.14 | 528 |
| Ex. 21 | 5 | 175 | 1.01 | 453 |
| Ex. 21 | 5 | 200 | 0.61 | 396 |
| Ex. 21 | 5 | 225 | 0.09 | 352 |
| control | 6 | 100 | 1.1 | 792 |
| control | 6 | 125 | 0.34 | 634 |
| Ex. 21 | 6 | 100 | 1.32 | 792 |
| Ex. 21 | 6 | 125 | 1.37 | 634 |
| Ex. 21 | 6 | 150 | 1.37 | 528 |
| Ex. 21 | 6 | 175 | 1.38 | 453 |
| Ex. 21 | 6 | 200 | 1.32 | 396 |
| Ex. 21 | 6 | 225 | 0.14 | 352 |
| control | 7 | 100 | 1.38 | 792 |
| control | 7 | 125 | 1.05 | 634 |
| Ex. 21 | 7 | 100 | 1.35 | 792 |
| Ex. 21 | 7 | 125 | 1.40 | 634 |
| Ex. 21 | 7 | 150 | 1.44 | 528 |
| Ex. 21 | 7 | 175 | 1.44 | 453 |
| Ex. 21 | 7 | 175 | 1.44 | 453 |
| Ex. 21 | 7 | 200 | 1.29 | 396 |
| Ex. 21 | 7 | 225 | 0.05 | 352 |

*Vd is drum speed in Revolutions Per Min.
**TaVF is total average fluence

Examples 22–26

These examples illustrate the use of different transfer layers to form donor elements according to the invention.

The donor film for each example had a support of Mylar® 200 D film, and a 5 micron thick ejection layer of PVC (coated from 60/40 MEK/CyHex). A heating layer of 60 Å of Cr was deposited by e-beam by Flex Products, Inc. (Santa Rosa, Calif.). The transfer layers having the compositions given in the table below were bar coated over this by hand from methylene chloride using a #6 rod, to a thickness of approximately 0.8 micron.

For each example a control was prepared having the same structure, but without the ejection layer.

TABLE 4

| | Transfer Layer Compositions | | | | |
|---|---|---|---|---|---|
| | Example (parts by weight) | | | | |
| Component | 22 | 23 | 24 | 25 | 26 |
| Binder: | | | | | |
| PSMMA | 37.5 | | | | |
| PC | | 37.5 | | | |
| SEB | | | 37.5 | | |
| AF1601 | | | | 37.5 | |
| K-1101 | | | | | 37.5 |
| Plasticizer: | | | | | |
| DPP | 0.5 | | | | |
| DBP | | 0.5 | | | |
| PEG | | | 0.5 | | |
| L31 | | | | | 0.5 |
| Colorant: | | | | | |
| K dispersion | 9.0 | 9.0 | 9.0 | 9.0 | 9.0 |

The sensitivities of the films were measured using Procedure 1 for both the Q-switched ("A") and long pulse modes ("B"). The results are given in Table 5 below and clearly demonstrate the increased sensitivity of the films having the ejection layer.

TABLE 5

| | Sensitivity (mJ/cm$^2$) | |
|---|---|---|
| Sample | A | B |
| Example 22 | 60 | 350 |
| Control 22 | 200 | 700 |
| Example 23 | 40 | 300 |
| Control 23 | 100 | 700 |
| Example 24 | 50 | 350 |
| Control 24 | 200 | 700 |
| Example 25 | 40 | 350 |
| Control 25 | 100 | 700 |
| Example 26 | 60 | 350 |
| Control 26 | 200 | 650 |

Example 27

The following example illustrates that the pigmented layer is not removed from the base when it is not in intimate contact with a receiver. The procedure of Example 21 was repeated with a receiver element of paper (Example 27A) and without a receiver element (Example 27B). Observation of the exposed donor element revealed that when imaged without a receiver, the appearance of the exposed areas changed from a shiny to a more dull appearance, but the pigmented layer was not removed from its place on the original donor film. That is, although a latent image was formed, no explosive transfer of material occured. In contrast, when the same material was in intimate contact with paper the pigmented layer was fully transferred.

| Sample ID | Vd (RPM) | TAvF (mJ/cm2) | Transfer | contact | receiver |
|---|---|---|---|---|---|
| Ex. 27A | 200 | 396 | yes | yes | paper |
| Ex. 27B | 350 | 256 | no | no | none |

Vd is taken as last visible line on donor element when not in contact and as last line transfer at SWOP (standard webb offset print) densities when in contact with receiver element.

What is claimed is:

1. A donor element for use in a laser-induced thermal transfer process, said element comprising a support bearing on a first surface thereof, in the order listed:

(a) at least one ejection layer comprising a first polymer having a decomposition temperature $T_1$° C.;

(b) at least one heating layer; and (c) at least one transfer layer comprising (i) a second polymer having a decomposition temperature $T_2$° C. and (ii) an imageable component;

wherein $T_2$° C.≧($T_1$° C.+100).

2. The element of claim 1 wherein the first polymer has a decomposition temperature less than 325° C. and is selected from the group consisting of alkyklsybstituted styrene polymers, polyacrylate esters, polymethacrylate esters, cellulose acetate butyrate, nitrocellulose, poly(vinyl chloride), polyacetals, polyvinylidene chloride, polyurethanes, polyesters, polyorthoesters, acrylonitrile, maleic acid resins, polycarbonates and copolymers and mixtures thereof.

3. The element of claim 1 wherein the heating layer comprises a thin metal layer selected from the group consisting of aluminum, chromium, nickel, zirconium, titanium, and titanium dioxide.

4. The element of claim 1 wherein the second polymer has a decomposition temperature greater than 400° C. and is selected from the group consisting of copolymers of acrylate esters, ethylene, and carbon monoxide and copolymers of methacrylate esters, ethylene and carbon monoxide.

5. The element of claim 1 wherein the first polymer is selected from the group consisting of poly(vinyl chloride) and nitrocellulose, the heating layer comprises a thin layer of metal selected from the group consisting of nickel and chromium, and the second polymer is selected from the group consisting of copolymers of polystyrene and copolymers of n-butylacrylate, ethylene and carbon monoxide.

6. The element of claim 1 wherein (a) the ejection layer has a thickness in the range of 0.5 to 20 micrometers, (b) The heating layer has a thickness in the range of 20 Å to 0.1 μm, and (c) the transfer layer has a thickness in the range of about 0.1 to 50 micrometers.

7. The element of claim 1 wherein the imageable component is a pigment.

8. A laser-induced, thermal transfer process which comprises:

(1) imagewise exposing to laser radiation a laserable assemblage comprising:

(A) a donor element having a support bearing on a first surface thereof, in the order listed:

(a) at least one ejection layer comprising a first polymer having a decomposition temperature $T_1$° C.;

(b) at least one heating layer;

(c) at least one transfer layer comprising (i) a second polymer having a decomposition temperature $T_2$° C. and (ii) an imageable component;

wherein $T_2$° C.≧($T_1$° C.+100); and (B) a receiver element in contact with the first surface of the donor element, wherein a substantial portion of the transfer layer is transferred to the receiver element; and (2) separating the donor element from the receiver element.

9. The process of claim 8 wherein the first polymer has a decomposition temperature less than 325° C. and is selected from the group consisting of alkylsubstituted styrene polymers, polyacrylate esters, polymethacrylate esters, cellulose acetate butyrate, nitrocellulose, poly(vinyl chloride), polyacetals, polyvinylidene chloride, polyurethanes, polyesters, polyorthoesters, acrylonitrile, maleic acid resins, polycarbonates and copolymers and mixtures thereof.

10. The process of claim 8 wherein the heating layer comprises a thin metal layer selected from the group consisting of aluminum, chromium, nickel, zirconium, titanium, and titanium dioxide.

11. The process of claim 8 wherein the second polymer has a decomposition temperature greater than 400° C. and is selected from the group consisting of copolymers of acrylate esters, ethylene and carbon monoxide and copolymers of methacrylate esters, ethylene and carbon monoxide.

12. The process of claim 8 wherein the first polymer is selected from the group consisting of polyvinyl chloride and nitrocellulose, the heating layer comprises a thin layer of metal selected from the group consisting of nickel and chromium, and the second polymer is selected from the group consisting of copolymers of polystyrene and copolymers of n-butylacrylate, ethylene and carbon monoxide.

13. The process of claim 8 wherein (a) the ejection layer has a thickness in the range of 0.5 to 20 micrometers, (b) The heating layer has a thickness in the range of 20 Å to 0.1 μm, and (c) the transfer layer has a thickness in the range of about 0.1 to 50 micrometers.

14. The process of claim, 8 wherein the imageable component is a pigment.

* * * * *